United States Patent [19]

Schwartz

[11] Patent Number: 4,588,516

[45] Date of Patent: May 13, 1986

[54] CLEANING LIQUID AND PROCESS OF USING SAME

[76] Inventor: Lenore F. Schwartz, 1412 Mt. Pleasant Rd., Villanova, Pa. 19085

[21] Appl. No.: 686,239

[22] Filed: Dec. 26, 1984

[51] Int. Cl.[4] ..... C11D 1/825

[52] U.S. Cl. ..... 252/174.21; 252/162; 252/174.22; 252/DIG. 14

[58] Field of Search ..... 252/174.21, 174.22, 252/DIG. 14, 122, 126, 130, 173, DIG. 1, 162

[56] References Cited

U.S. PATENT DOCUMENTS

| | | | |
|---|---|---|---|
| 3,156,655 | 11/1964 | Bright | 252/174.22 |
| 3,208,949 | 9/1965 | Milan | 252/174.22 |
| 3,429,822 | 2/1969 | Grunewald | 252/174.22 |
| 3,737,387 | 6/1973 | Marple | 252/174.21 |
| 4,285,840 | 8/1981 | Fricker | 252/174.21 |

*Primary Examiner*—Paul Lieberman
*Assistant Examiner*—Hoa Van Le
*Attorney, Agent, or Firm*—Austin R. Miller

[57] ABSTRACT

A liquid cleaning composition especially suitable for use in lukewarm water and a method of using the composition for cleaning fabric which is at least partially composed of cotton. The liquid cleaner comprises a solution of the following components: a dodecyl phenol with 8–9 ethylene oxide units in a side chain, a nonyl phenol with 9 ethylene oxide units in a side chain, a polyethylene glycol ether of a mixture of long chain (11–15 carbon atoms) fatty alcohols with 9 mols ethylene oxide, a polyoxyethylene-polyoxypropylene block copolymer defoaming agent, 2-methyl-2,4-pentane-diol, polyoxyethylene (20) oleyl ether and optionally, water.

The method of using the cleaning composition comprising the steps of mixing the composition with water, saturating the fabric with the mixture, rinsing the mixture from the fabric with water, and heating the fabric to substantially complete dryness.

4 Claims, No Drawings

CLEANING LIQUID AND PROCESS OF USING SAME

BACKGROUND OF THE INVENTION

1. Field of the Invention

The present invention relates to a cleaning composition and method of using same and more particularly to a liquid cleaning composition and process for washing cotton garments, especially fine cotton garments such as sweaters.

2. Description of the Prior Art

U.S. Pat. No. 3,156,655 to Bright discloses a liquid detergent composition containing seven essential components. One component is water which serves as a dissolving, suspending or emulsifying medium for the remaining components of the composition.

Two further components constitute a synthetic organic non-ionic non-soap detergent mixture of from about 7%–10% by weight of the composition. Of this mixture, one component comprises an alkylphenol-ethyleneoxide condensate having an alkyl group containing from 9%–12% carbon atoms and containing 9%–15% oxyethylene units. Mentioned examples include "Sterox DJ", "Igepal CO 630" and "Tergitol NPX". The remaining component in the mixture is a polyoxyalkylene alkanol containing from 0–20% ethylene oxide. A mentioned example is "Pluronic L-61".

In addition, the Bright patent discloses that small amounts of dyes, colorants and perfumes may be added to the liquid detergent.

U.S. Pat. No. 3,429,822, to Grunewald et al discloses a detergent having a water soluble surface active agent comprising an ethylene oxide adduct having good cleaning power and a high foaming tendency and a water insoluble surface-active dialkyl phenol-ethylene oxide adduct having a low forming tendency and relatively poor cleaning power.

As the water-soluble surface-active ethylene oxide adduct having good cleaning power and a high foaming tendency, there is mentioned the pluronic agents manufactured by Wyandotte Chemical Corporation as well as the Igepal agents.

In recent years there has been an increase in the popularity of fine washable garments composed at least partly from cotton fibers. For instance, there has recently been greatly increased popularity of cotton sweaters.

Generally, people washing fine cotton garments such as cotton sweaters have refrained from machine washing these garments for fear of damage and/or shrinkage to the garment.

In addition, there has been a widely held belief that fine washables including fine washables composed at least partially of cotton, should be washed in cold (i.e., below 90° F.) water.

I have now surprisingly discovered a completely novel cleaning composition and method of using same adapted specifically for the washing of fine cotton washables such as sweaters. Further, with my new liquid cleaning composition, conventional washing machines such as residential home and commercial washers may be used on a delicate cycle to wash fine cotton washables, especially sweaters containing cotton.

SUMMARY OF THE INVENTION

My novel liquid cleaning composition comprises a combination of ingredients including a Dodecyl phenol with 8–9 ethylene oxide units in a side chain; a Nonyl phenol with 9 ethylene oxide units in a side chain; a polyethylene glycol ether of a mixture of long chain (11–15 carbon atoms) fatty alcohols with 9 mols ethylene oxide; a polyoxyethylene-polyoxypropylene block copolymer defoaming agent; 2-methyl-2,4-pentane-diol; polyoxyethylene 20 oleyl ether; and water. This composition becomes highly activated by luke warm water to synergistically clean garments composed at least partially of cotton.

In addition, my new cleaning composition may contain additional non-essential ingredients such as perfumes and dyes.

DESCRIPTION OF THE PREFERRED EMBODIMENTS

A preferred embodiment of my liquid cleaning composition comprises the following: 2.0–12.0 wt. %, preferably about 7.0 wt. % of a dodecyl phenol with 8–9 ethylene oxide units in a side chain sold under the tradename "Sterox DJ" by the Monsanto Company; 2.0–12.0 wt. %, preferably about 7 wt. % of a nonyl phenol with 9 ethylene oxide units in a side chain sold under the tradename "Igepal CO 630" by the GAF Corporation; 2.0–12.0 wt. %, preferably about 7.0 wt. % of a polyethylene glycol ether of a mixture of long chain (11–15 carbon atoms) fatty alcohols with 9 mols ethylene oxide, sold under the tradename "Tergitol 15-S-9" by the Union Carbide Company; 0.5–5.0 wt. %, preferably about 2.0 wt. % of a polyoxyethylene-polyoxypropylene block copolymer defoaming agent, sold under the tradename "Pluronic L-61" by BASF Company; 5.0–15.0 wt. %, preferably about 10.0 wt. % of 2-methyl-2,4-pentane-diol; 20.0–30.0 wt. %, preferably about 25.0 wt. % of polyoxyethylene 20 oleyl ether, sold under the tradename "AHCO-3998" by Imperial Chemical Industries, Inc.; and 35.0–50.0 wt. %, preferably about 42 wt. % water.

My preferred cleaning composition may also contain additional ingredients such as perfumes and dyes.

The process of using my new cleaning formulation is described hereinbelow. My new cleaning formulation may be used to clean fine cotton washables in typically residential washing machines. Typically, one fluid ounce of my liquid cleaning composition is added to a residential washer set on a delicate cycle. Typically, such a delicate cycle will contain approximately 19 gallons of water at a temperature ranging between about 90° F. to about 120° F. (i.e., luke warm). My new cleaning composition should preferably not be used with cold water.

Once the cotton garment has been washed and rinsed, it is important to remove substantially all of the water from the garment so that it will retain its shape. Furthermore, residual water left in the garment contributes to yellowing caused by mildew. Thus, I recommend drying the cotton garment in a commercial or residential dryer set on a low heat setting (approximately 130° F.). Preferably the drying should be discontinued just prior to when the cotton garment becomes bond dry. At this point, the garment should be removed from the dryer and set out for proper shaping. Caution must be exercised since further drying of the garment beyond complete dryness will result in shrinkage.

One embodiment of my cleaning composition and method of using same is illustrated in the example set forth below.

EXAMPLE 1

The following five ingredients were placed in a mixing tank and thoroughly mixed:

| Ingredient | Amount |
|---|---|
| Sterox DJ | 7.0 lbs. |
| Igepal C030 | 7.0 lbs. |
| Tergitol 15-S-9 | 7.0 lbs. |
| Pluronic L-61 | 2.0 lbs. |
| Hexylene glycol | 10.0 lbs. |

To the above mixture was added 5.0 gallons of warm water having a temperature of about 90° F. Mixing was continued until the components were thoroughly mixed. Twenty-five pounds of AHCO-3998 was melted and slowly added to the batch with mixing.

Perfume and dyestuff was added to the mixture in the amounts of 0.8 ml/gallon and 0.008 gm/gallons of composition, respectively. The batch was again well mixed.

I claim:

1. A composition for cleaning cotton fabrics comprising in combination:
   (a) about 2–12 weight percent of a dodecyl phenol with 8–9 ethylene oxide units in a side chain;
   (b) about 2–12 weight percent of a nonyl phenol with 9 ethylene oxide units in a side chain;
   (c) about 2–12 weight percent of a polyethylene glycol ether of a mixture of long chain (11–15 carbon atoms) fatty alcohols with 9 mols of ethylene oxide;
   (d) about 0.5–50 weight percent of a polyoxyethylenepolyoxypropylene block copolymer defoaming agent;
   (e) about 5–15 weight percent of 2-methyl-2, 4-pentane-diol; and
   (f) about 20–30 weight percent of polyoxyethylene (20) oleyl ether.

2. A liquid cleaning composition for cleaning cotton fabrics comprising the composition as described in claim 1 and about 35–50 weight percent water.

3. A composition for cleaning cotton fabrics comprising in combination:
   (a) about 7 weight percent of a dodecyl phenol with 8–9 ethylene oxide units in a side chain;
   (b) about 7 weight percent of a nonyl phenol with 9 ethylene oxide units in a side chain;
   (c) about 7 weight percent of a polyethylene glycol ether of a mixture of long chain (11–15 carbon atoms) fatty alcohols with 9 mols of ethylene oxide;
   (d) about 2 weight percent of a polyoxyethylenepolyoxypropylene block copolymer defoaming agent;
   (e) about 10 weight percent of 2-methyl-2,4-pentanediol; and
   (f) about 25 weight percent of polyoxyethylene (20) oleyl ether.

4. A liquid cleaning composition for cleaning cotton fabrics comprising the composition as described in claim 1 and about 42 weight percent water.

* * * * *